US007197895B2

(12) United States Patent
Schwarz

(10) Patent No.: US 7,197,895 B2
(45) Date of Patent: Apr. 3, 2007

(54) FIXING SYSTEM FOR FIXING A JEWELLERY ELEMENT TO A PIECE OF JEWELLERY AND PIECE OF JEWELLERY

(75) Inventor: Wolf-Peter Schwarz, Ulm (DE)

(73) Assignee: Ehinger-Schwarz GmbH & Co. KG, Ulm (DE)

( * ) Notice: Subject to any disclaimer, the term of this patent is extended or adjusted under 35 U.S.C. 154(b) by 37 days.

(21) Appl. No.: 10/509,769

(22) PCT Filed: May 6, 2003

(86) PCT No.: PCT/EP03/04749

§ 371 (c)(1),
(2), (4) Date: Sep. 28, 2004

(87) PCT Pub. No.: WO03/094649

PCT Pub. Date: Nov. 20, 2003

(65) Prior Publication Data

US 2005/0120745 A1 Jun. 9, 2005

(30) Foreign Application Priority Data

May 14, 2002 (DE) ..... 101 07 565
Jul. 4, 2002 (DE) ..... 202 10 344 U

(51) Int. Cl.
*A44C 17/02* (2006.01)

(52) U.S. Cl. ..... 63/29.1; 63/40

(58) Field of Classification Search ..... 63/26–28, 63/29.1, 29.2, 30, 31, 40
See application file for complete search history.

(56) References Cited

U.S. PATENT DOCUMENTS 4,793,155 A * 12/1988 Law ..... 63/40

* cited by examiner

*Primary Examiner*—Jack W. Lavinder
(74) *Attorney, Agent, or Firm*—Scully, Scott, Murphy & Presser, P.C.

(57) ABSTRACT

The present invention relates to a fastening system for fastening a jewellery element (3) to an item of jewellery (12) and an item of jewellery comprising the fastening system according to the invention. The fastening system comprises a setting constructed on the item of jewellery (12) with a support part (1) and a fastening device (2) and a jewellery element (3) releasably fastenable on the support part (1) of the setting by means of the fastening device (2), the support part (1) comprising an aperture (4) which is capable of at least partially receiving the jewellery element (3). According to the invention the fastening device (2) is constructed on the support part (1) and comprises an externally actuatable leaf spring ($\mathbf{2}_1$) and a latching element ($\mathbf{2}_2$) constructed on the leaf spring ($\mathbf{2}_1$), the jewellery element (3) comprising a recess (5) which is constructed to work in cooperation with the latching element ($\mathbf{2}_2$) of the fastening device (2) when the jewellery element (3) is located in the aperture (4) of the support part (1).

10 Claims, 5 Drawing Sheets

FIXING SYSTEM FOR FIXING A JEWELLERY ELEMENT TO A PIECE OF JEWELLERY AND PIECE OF JEWELLERY

The present invention relates to a fastening system for fastening a jewellery element to an item of jewellery.

The fastening system comprises a setting constructed on the item of jewellery with a support part and a fastening device and a jewellery element releaseably fastenable on the support part of the setting by means of the fastening device. The support part further comprises an aperture which is capable of at least partially receiving the jewellery element.

The item of jewellery comprises a support part, a fastening a device and a jewellery element releaseably fastenable on the support part by means of the fastening device. The support part further comprises an aperture which is capable of at least partially receiving the jewellery element.

Due to their considerable variability and good adaptability to different occasions, items of jewellery with exchangeable jewellery elements are enjoying increasing popularity.

Fr-A-2 764 784 discloses an item of jewellery with an annular element and a jewellery element fastenable thereto, in which the annular element comprises a groove which is curved corresponding to the curve of the annular element. A leaf spring is provided in the groove. The leaf spring comprises a bead with which it can prevent a web of the jewellery element inserted into the curved groove from moving within the groove. The jewellery element is held on the annular element via the web and the leaf spring.

An item of jewellery with a support part (such as a ring or a brooch) and a removable jewellery element (such as a precious stone or a pearl) is known for example from DE 196 53 163.2, the jewellery element being removably fixable to the support part by means of a web. The web is guided through a through bore constructed in the jewellery element and can be engaged into recesses constructed in the support part. The web preferably comprises at least one elastically displaceable end part therefor, whereby the jewellery element is removable from the support part by manipulating the web, however an undesired inadvertent release of the connection of the jewellery element and the support part is prevented.

The known solution is particularly disadvantageous in that the fastening of the jewellery element to the support part and the release of the jewellery element from the support part is relatively awkward due to the separate web, as in the intervening period the web is only loosely arranged in the through bore constructed in the jewellery element. Therefore the web can easily slip out and become mislaid when, to fasten the jewellery element to the support part, the jewellery element has to be brought together with the web held therein onto the support part. Furthermore when the jewellery element is fastened to the support part, releasing the web is generally only possible with aids, such as for example clamps or pins, as directly gripping the web is prevented by the presence of the jewellery element.

The object of the present invention is therefore to construct a fastening system for fastening a jewellery element to an item of jewellery in such a manner that, on the one hand, the jewellery element can be easily released from the item of jewellery and be fastened again to the item of jewellery without a separate tool, and on the other hand an inadvertent release of the connection of the jewellery element and the item of jewellery is reliably prevented.

it is a further object of the present invention to construct an item of jewellery in such a manner that the jewellery element on the one hand can be easily removed from the support part and reinserted without a separate tool and yet an inadvertent release of the connection of the jewellery element and support part is reliably prevented.

In summary, it is therefore the object of the present invention to construct a fastening device of a fastening system to fasten a jewellery element to an item of jewellery and a fastening device of an item of jewellery in such a manner that on the one hand the jewellery element can easily be removed from the item of jewellery and support part without a separate tool, and on the other hand an inadvertent release of the connection of the jewellery element and item of jewellery and support part is reliably prevented.

The fastening system to fasten a jewellery element to an item of jewellery according to the present invention comprises a setting constructed on the item of jewellery with a support part and a fastening device and a jewellery element releasably fastenable to the support part of the setting by means of the fastening device. Moreover the support part comprises an aperture which is capable of at least partially receiving the jewellery element.

According to the invention the fastening device is constructed on the support part and comprises an externally actuatable leaf spring and a latching element constructed on the leaf spring. The jewellery element further comprises a recess which is constructed to work in cooperation with the latching element of the fastening device when the jewellery element is located in the aperture of the support part.

As the fastening device of the setting of the fastening system according to the invention is produced in the form of a leaf spring constructed on the support part and provided with a latching element, the fastening device has no component separate from the support part when the setting is ready for use. As the fastening device does not therefore have to be specially arranged on the support part when the jewellery element is fastened and therefore also cannot be mislaid, fastening the jewellery element to the item of jewellery by means of the fastening system according to the invention is particularly easy.

As the leaf spring is furthermore externally actuatable, the jewellery element can easily be removed from the support part of the setting and thus from the item of jewellery and fastened again to the support part and thus to the item of jewellery without a separate tool.

Furthermore, due to the low thickness, compared to spiral springs, of the leaf spring used according to the invention, it is possible for the setting for fastening a jewellery element to an item of jewellery to be of particularly compact construction.

As the jewellery element to be held by the setting of the fastening system according to the invention comprises a recess which is constructed to work in cooperation with the latching element of the fastening device when the jewellery element is located in the aperture of the support part, it is further ensured that the jewellery element is releasably and yet reliably held on the support part of the setting and thus on the item of jewellery.

According to a preferred embodiment of the fastening system according to the invention an actuation element is further provided on the fastening device of the setting, to facilitate the external actuation of the leaf spring. By providing an actuation element on the leaf spring it is possible, for example, to increase a point of application of a force producing the actuation of the leaf spring or possibly to guide it beyond the support element of the setting and through the support element. Furthermore the point of application of a force producing the actuation of the leaf spring can be guided by means of the actuation element at a point on the item of jewellery where the overall aesthetic impression of the item of jewellery is not or only slightly reduced and an inadvertent actuation of the leaf spring can possibly be avoided.

Moreover it is particularly advantageous when the actuation element is constructed in the form of a lever which is arranged perpendicular to an extension direction of the latching element on the fastening device.

To ensure particularly simple operability of the actuation element it is further advantageous when a notch is provided in the support part to guide a movement of the actuation element.

According to a particularly preferred embodiment of the fastening system according to the invention the support part comprises a groove and the leaf spring of the fastening device is arranged in the groove of the support part.

It is particularly advantageous when the groove of the support part is of annular construction and surrounds the aperture for the jewellery element and the leaf spring is of correspondingly curved construction. In this case the leaf spring can be particularly easily fastened to the support part by snapping into place in the groove.

It is furthermore very advantageous when the leaf spring of the fastening device together with the latching element is tangentially displaceable in the groove of the support part after a radial actuation of the leaf spring. It is thus possible in a simple manner to release the cooperation between the latching element of the fastening device and the recess of the jewellery element permanently so that the jewellery element can be particularly easily released from the setting of the fastening system according to the invention and thus from the item of jewellery.

The aperture for the jewellery element in the support part can be particularly easily provided when it is designed as a cylindrical bore. With a corresponding configuration of the jewellery element and the recess constructed in the jewellery element this moreover allows a rotatability of the jewellery element fastened by means of the fastening device to the support part.

The secure and reliable functioning method of the fastening device of the setting of the fastening system according to the invention can in particular be further improved in that in the support part perpendicular to the aperture for the jewellery element a bore is constructed in which the latching element of the fastening device projecting into the aperture is guided.

Preferably the jewellery element of the fastening system according to the invention can be constructed as a setting for a precious stone or a pearl.

To increase the variability further of the fastening system according to the invention the jewellery element can comprise a cylindrical portion and a head and be constructed to fasten releasably at least one decorative element comprising a bore to the support part. It is thus possible to provide further decorative elements on the support part of the setting and thus on the item of jewellery additional to the jewellery element releasably fastened to the support part.

If a rotatability of the jewellery element in the setting of the fastening system according to the invention is to be ensured, then it is advantageous when the recess provided in the jewellery element is constructed in the form of an annular groove.

To allow particularly easy fastening of the jewellery element to the setting and thus to the item of jewellery, the jewellery element preferably comprises a chamfer below the recess which is constructed to effect a displacement of the latching element constructed on the leaf spring when the jewellery element is inserted into the aperture of the support part.

The item of jewellery according to the present invention which achieves the same inventive principle as the fastening system according to the invention, comprises a support part, a fastening device and a jewellery element releasably fastened to the support part by means of the fastening device, the support part comprising an aperture which is capable of at least partially receiving the jewellery element.

According to the invention the fastening device is constructed on the support part and comprises an externally actuatable leaf spring and a latching element constructed on the leaf spring. The jewellery element further comprises a groove which is constructed to work in cooperation with the latching element of the fastening device when the jewellery element is located in the aperture of the support part.

As the fastening device according to the present invention is produced in the form of a leaf spring constructed on the support part and thus represents no separate part which has to be specially arranged on the support part when the jewellery element is fastened and thus can become mislaid, the fastening of the jewellery element to the support part is particularly easy. As the leaf spring is furthermore externally actuatable, the jewellery element can be easily removed from the support part and reinserted without a separate tool. Due to the low thickness, compared to spiral springs, and clear form of the leaf spring used according to the invention, it is furthermore possible to incorporate this easily into the design of the support part and thus the item of jewellery according to the invention, so that the solution according to the invention is particularly aesthetic. Due to the groove provided on the jewellery element of the item of jewellery according to the invention, and which is constructed to work in cooperation with the latching element of the fastening device when the jewellery element is located in the aperture of the support part, it is further ensured that the jewellery element is releasably and yet reliably held on the support part.

According to a preferred embodiment the leaf spring of the fastening device is arranged on an outer surface of the support part and can thus represent a design feature of the item of jewellery.

Moreover it is particularly advantageous when the leaf spring of the fastening device is flush mounted in the outer surface of the support part, as the item of jewellery according to the invention can thus be particularly comfortably handled and an inadvertent actuation of the fastening device, for example by becoming caught on clothes or the like, can be avoided.

To ensure particularly easy operability of the fastening device it is further advantageous when the support part is constructed in such a manner that an actuation of the leaf spring is possible by reaching behind.

According to a preferred embodiment the support part can comprise in the region of the aperture for the jewellery element a chamfer therefor, which is covered by a side edge of the leaf spring.

According to a particularly preferred embodiment the support part is constructed as a jewellery ring and the leaf spring of the fastening device is of correspondingly annular construction.

The aperture for the jewellery element in the support part can be particularly easily provided if it is designed as a cylindrical bore. With a corresponding embodiment of the jewellery element this moreover allows a rotatability of the jewellery element fastened to the support part by means of the fastening device.

The safe and reliable functioning method of the fastening device of the item of jewellery according to the invention can in particular be further improved when in the support part perpendicular to the aperture for the jewellery element a bore is constructed in which the latching element of the fastening device projecting into the aperture is guided.

Preferably the jewellery element can be constructed as a setting for a precious stone or a pearl.

To further increase the variability of the item of jewellery according to the invention the jewellery element can comprise a cylindrical portion and a head and be constructed to fasten releasably at least one decorative element comprising a bore to the support part. It is thus possible to provide further decorative elements on the support part of the item of jewellery according to the invention in addition to the jewellery element releasably fastened to the support part.

The present invention will hereinafter be described with reference to the drawings, in which.

In the following drawings elements exercising essentially similar effects are provided with the same reference numerals. To increase the clarity of the drawings the item of jewellery is not specifically shown in FIGS. 1, 2A and 2B.

Figure 1:
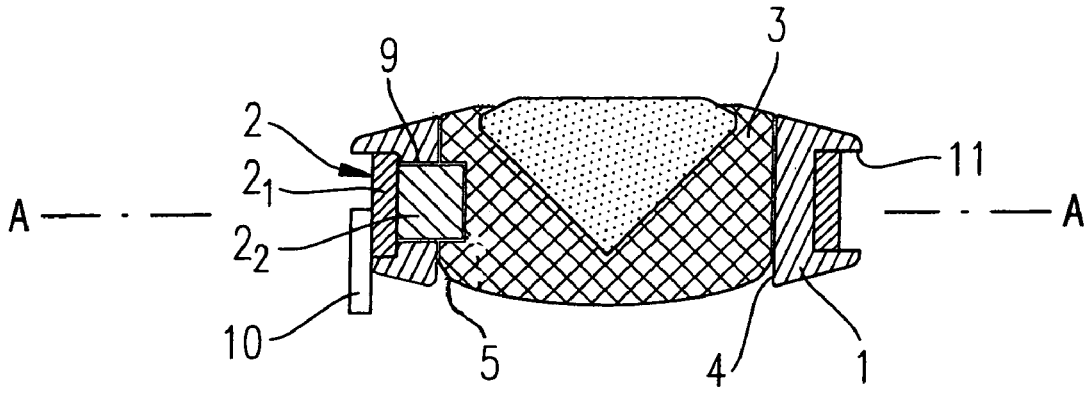
FIG. 1 is a cross section through essential elements of a fastening system according to a first preferred embodiment of the present invention, the item of jewellery however not being shown.

According to a particularly preferred first embodiment of the present invention shown in FIG. 1 in cross section, the fastening system according to the invention for fastening a jewellery element 3 to an item of jewellery comprises a setting provided on the item of jewellery (not shown) with a support part 1 and a fastening device 2 constructed on the support part 1.

The fastening device 2 comprises an externally actuatable leaf spring $\mathbf{2}_1$, and a latching element $\mathbf{2}_2$ constructed on the leaf spring $\mathbf{2}_1$. According to the particularly preferred embodiment shown in FIG. 1 an actuation element 10 in the form of a lever is fastened to the leaf spring $\mathbf{2}_1$ in the region of the latching element $\mathbf{2}_2$. Moreover the lever, as depicted, is preferably oriented perpendicular to the extension direction of the latching element $\mathbf{2}_2$. As is clear from FIG. 1, the actuation element serves to guide the point of application of a force producing the actuation of the leaf spring $\mathbf{2}_1$ downwards and beyond the support element 1 of the setting, to facilitate an external actuation of the leaf spring $\mathbf{2}_1$.

According to an alternative embodiment not shown, the support element can however also comprise a notch (for example in the form of a chamfer or groove) which facilitates an external actuation of the leaf spring $\mathbf{2}_1$.

The fastening system according to the invention shown in FIG. 1 further comprises a jewellery element 3 releasably fastened to the support part 1 of the setting by means of the fastening device 2.

In the support part 1 of the setting an aperture 4 in the form of a cylindrical bore is introduced which predominantly receives the jewellery element 3. Perpendicular to the aperture 4 for the jewellery element 3 the support part 1 further comprises a bore 9, in which the latching element $\mathbf{2}_2$ of the fastening device 2 projecting into the aperture 4 is guided. Moreover the latching element $\mathbf{2}_2$ projects into the aperture 4 for the jewellery element 3 when the leaf spring 21 is not actuated.

A recess 5 in the form of an indentation is constructed in the jewellery element 3 which in the embodiment shown is constructed as a setting for a precious stone and as a whole comprises a cylindrical form.

As is clear from FIG. 1, the latching element $\mathbf{2}_2$ of the fastening device 2 and the recess 5 of the jewellery element 3 correspond to one another in such a manner that the latching element $\mathbf{2}_2$ engages in the recess 5 of the jewellery element 3 due to the spring action of the leaf spring $\mathbf{2}_1$ when the jewellery element 3 is located in the aperture 4 of the support part 1. The jewellery element 3 located in the aperture 4 is thus held securely on the support part 1 by means of the fastening device 2.

By the configuration of the recess 5 in the form of an indentation a rotatability of the jewellery element 3 fastened to the support part 1 by means of the fastening device 2 is prevented in the present case.

To allow both easy insertion of the jewellery element 3 in the aperture 4 of the support part 1, and to effect an automatic displacement of the latching element $\mathbf{2}_2$ of the fastening device 2 constructed on the leaf spring $\mathbf{2}_1$ when inserting the jewellery element 3, the jewellery element 3—as shown in FIG. 1—can comprise a corresponding chamfer 12 below the recess 5.

Figure 2A:
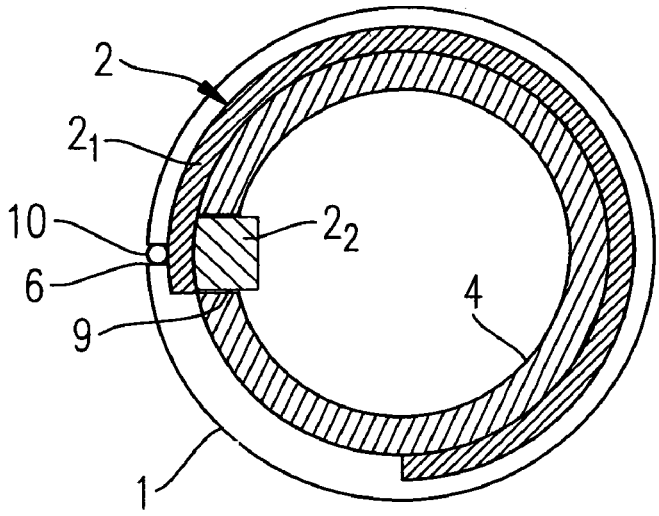
FIG. 2A is a cross sectional view through a setting of the fastening system shown in FIG. 1, the leaf spring not being actuated.
Figure 2B:
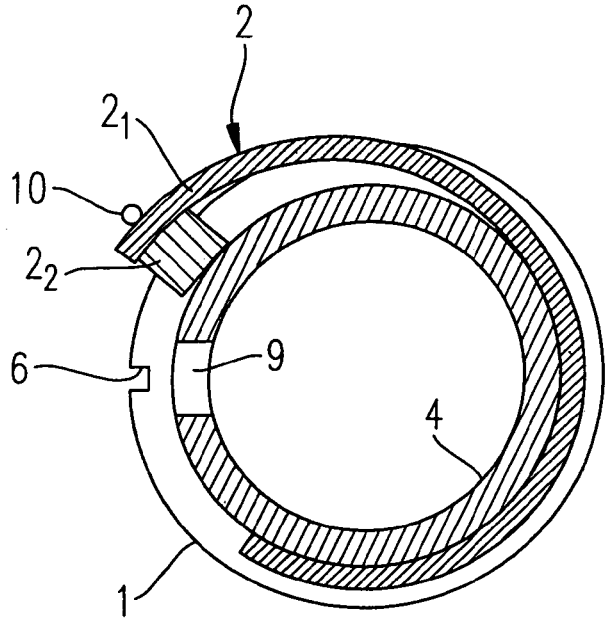
FIG. 2B is the cross sectional view from FIG. 2A, the leaf spring however being actuated.

FIGS. 2A and 2B show a cross sectional view through the fastening system in FIG. 1 along the cutting line A—A, no jewellery element 3 however being arranged in the setting.

As is apparent in FIGS. 1, 2A and 2B, according to this preferred embodiment, in the support part 1 an annular groove 11 is further introduced which surrounds the aperture 4 for the jewellery element 3. The leaf spring $\mathbf{2}_1$ in the embodiment shown is of a correspondingly curved construction and is held on the support part 1 by snapping into place in the annular groove 11. Consequently the setting of the fastening system according to the invention can be particularly easily produced. It is evident that the radius of the leaf spring $\mathbf{2}_1$, in the relaxed state, has to be selected to be smaller or the same as the inner radius of the annular groove 11 in the support part 1.

A notch 6 is further introduced into the support part 1 which is capable of receiving the actuation element 10 constructed in the form of a lever, when the leaf spring $\mathbf{2}_1$ is not actuated. This is shown in FIG. 2A. The notch 6 serves both to keep the actuation element 10 in its resting position when the leaf spring $2_1$ is not actuated, and also to guide a movement of the actuation element 10 when the leaf spring $2_1$ is actuated.

According to an alternative embodiment not specifically shown the notch 6 can be of ramp-like construction or in the form of a guide groove surrounding the actuation element to improve the guiding of the actuation element 10.

As is particularly clear in FIG. 2B, the groove 11 in the support part 1 and the leaf spring $2_1$ of the fastening device 2 are constructed according to this particularly preferred embodiment, to allow a tangential displacement (relative to the groove 11) of the leaf spring $2_1$ together with the latching element $2_2$ after a radial actuation of the leaf spring $2_1$ following a movement of the actuation element 10 directed away from the aperture 4. Therefore the latching element $2_2$ comes to rest on the support part 1, so that the cooperation between the latching element $2_2$ of the fastening device 2 and the recess 5 of the jewellery element 3 (not shown here) is permanently released. This allows the jewellery element 3 held by the setting of the fastening system according to the invention to be particularly easily removed.

A second embodiment of the item of jewellery according to the invention will hereinafter be described with reference to FIGS. 3, 4 and 5.

Figure 3:
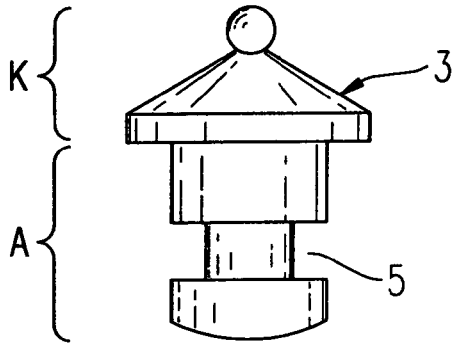
FIG. 3 is a side view of a jewellery element of the fastening system according to a second embodiment of the present invention.

This second embodiment differs from the aforementioned first embodiment in particular in that the jewellery element 3 comprises a cylindrical portion A and a head K as shown in FIG. 3.

Figure 4:
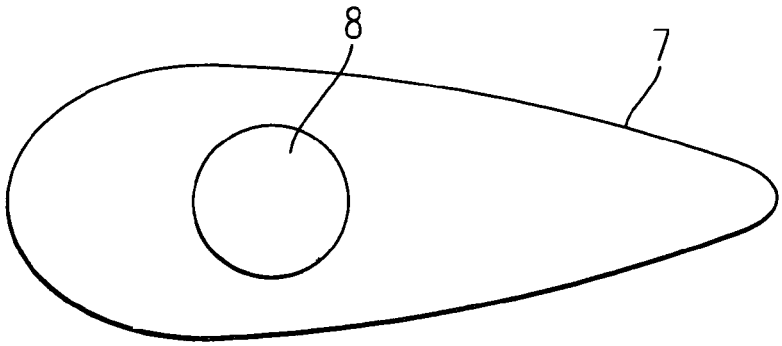
FIG. 4 is a plan view of a decorative element which is releasably fastenable to the setting of the fastening system by means of the jewellery element shown in FIG. 3.

Therefore it is possible, via the jewellery element 3, to fasten releasably a decorative element 7 shown diagrammatically in FIG. 4 in plan view, which comprises a bore 8 for the cylindrical portion A of the jewellery element 3, to the support part 1 of the setting of the fastening system according to the invention and thus to the item of jewellery.

Moreover varying heights of the cylindrical portion A of different jewellery elements 3 can be selected, either to be able to fasten a plurality of decorative elements 7 simultaneously to the support part 1, or to allow an adaptation to different thicknesses of the decorative element 7.

Furthermore the recess 5 provided in the jewellery element 3 according to this second embodiment is formed not from an indentation or bore but from an annular groove. In the present case this allows a rotatability of the jewellery element 3 fastened to the support part 1 by means of the fastening device 2 relative to the support part 1 and thus relative to the item of jewellery.

Figure 5:
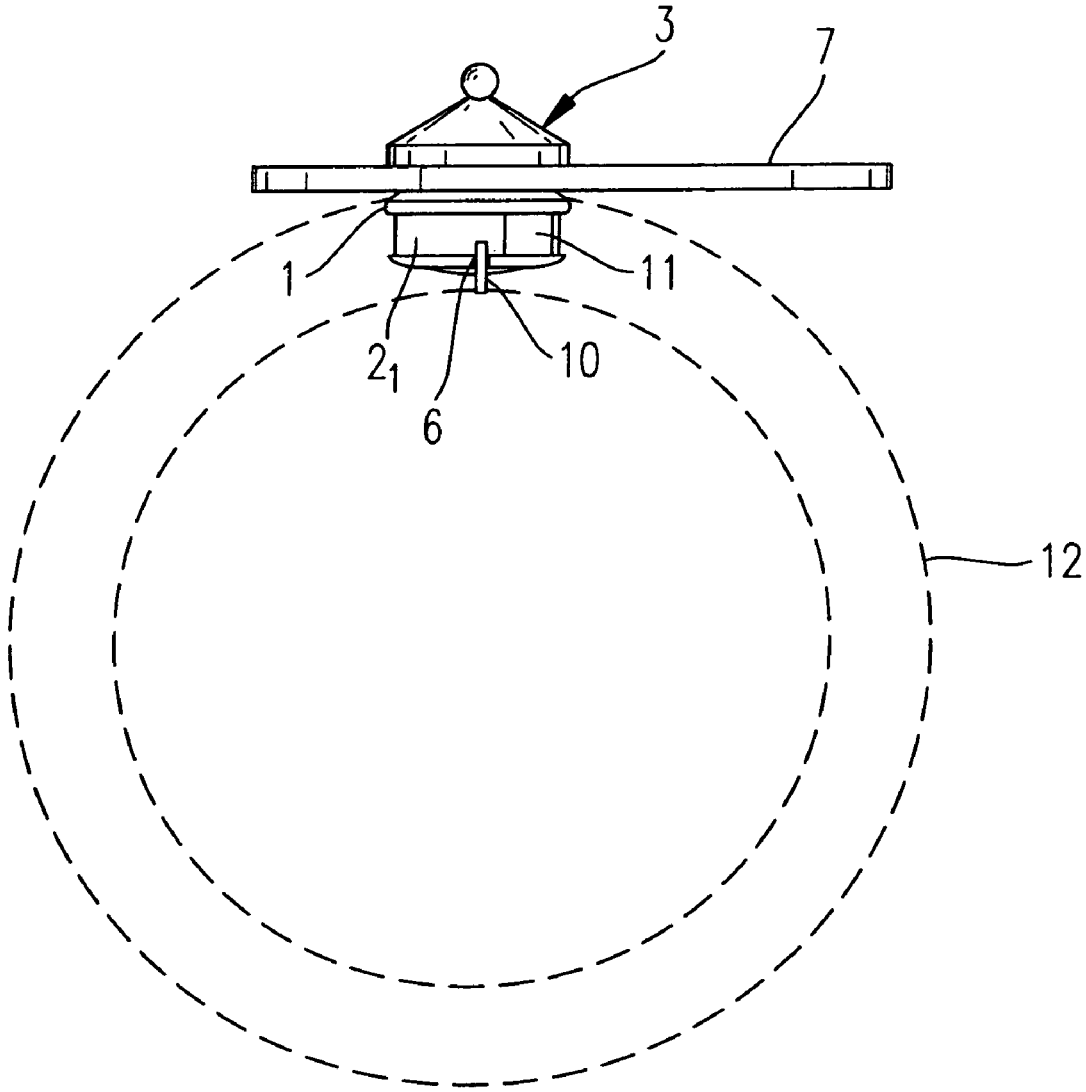
FIG. 5 is a side view of the fastening system according to the second embodiment.

FIG. 5 shows a side view of a fastening system according to the invention according to the aforementioned second embodiment in which the decorative element 7 is releasably fastened to the support part 1 via the jewellery element 3 by means of the fastening device 2 and thus to the item of jewellery 12 indicated by dotted lines.

As is indicated in FIG. 5 by the ring shown by dotted lines, the setting of the fastening system according to the invention is incorporated in an item of jewellery 12, for example in a ring, an earring, a brooch or a chain and constructed or arranged on the respective item of jewellery.

In summary the fastening system according to the invention allows the easy fastening and removal of different jewellery elements on an item of jewellery, without a separate tool being required therefor. At the same time the fastening system according to the invention reliably prevents inadvertent release of the connection between the support part and the jewellery element.

Figure 6:
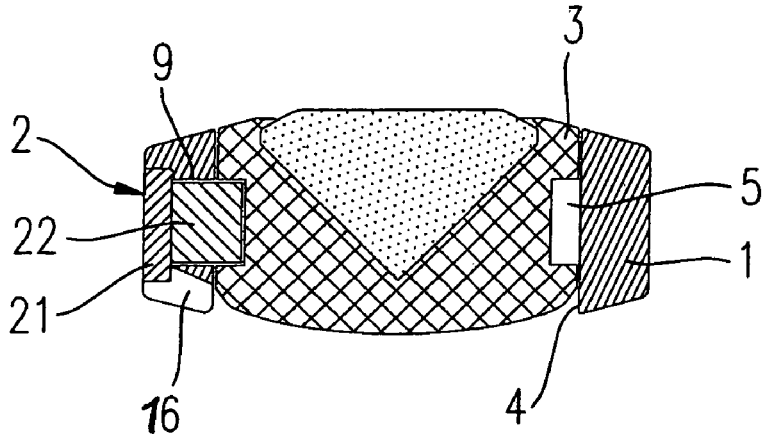
FIG. 6 is a cross section through essential elements of an item of jewellery according to a third preferred embodiment of the present invention.

According to a third particularly preferred embodiment of the present invention shown in FIG. 6 in cross section, an item of jewellery according to the invention which achieves the same inventive idea as the fastening system according to the invention, comprises a support part 1, a fastening device 2 constructed on the support part 1 with an externally actuatable leaf spring 21 and a latching element 22 constructed on the leaf spring 21 and a jewellery element 3 releasably fastened to the support part 1 by means of the fastening device 2.

In the support part 1 an aperture 4 in the form of a cylindrical bore is introduced which predominantly receives the jewellery element 3. The support part 1 further comprises perpendicular to the aperture 4 a bore 9 in which the latching element 22 of the fastening device 2 is guided. Moreover the latching element 22 projects into the aperture 4 for the jewellery element 3 when the leaf spring 21 is not actuated.

An annular groove 5 is constructed in the jewellery element 3, which in the embodiment shown is constructed as a setting for a precious stone and as a whole comprises a cylindrical form.

As is clear from FIG. 1 the latching element 22 of the fastening device 2 and the groove 5 of the jewellery element 3 correspond to one another in such a manner that due to the spring action of the leaf spring 21 when the jewellery element 3 is located in the aperture 4 of the support part 1 the latching element 22 engages in the groove 5 of the jewellery element 3. Consequently the jewellery element 3 located in the aperture 4 is fastened securely to the support part 1 by means of the fastening device 2.

A rotatability of the jewellery element 3 fastened to the support part 1 by means of the fastening device 2 is made possible in the present case by the annular configuration of the groove 5.

According to a not specifically shown alternative embodiment it is however also possible to provide in the jewellery element, instead of the annular groove, a recess (for example in the form of a bore or an indentation) which is constructed to work in cooperation with the latching element 22 of the fastening device 2. A rotatability of the jewellery element can therefore be prevented.

To allow easy introduction of the jewellery element 3 into the aperture 4 of the support part 1 and possibly an automatic displacement of the latching element 22 of the fastening device 2 when the jewellery element 3 is introduced, the jewellery element 3—as shown in FIG. 1—can be correspondingly chamfered on one side.

Figure 7:
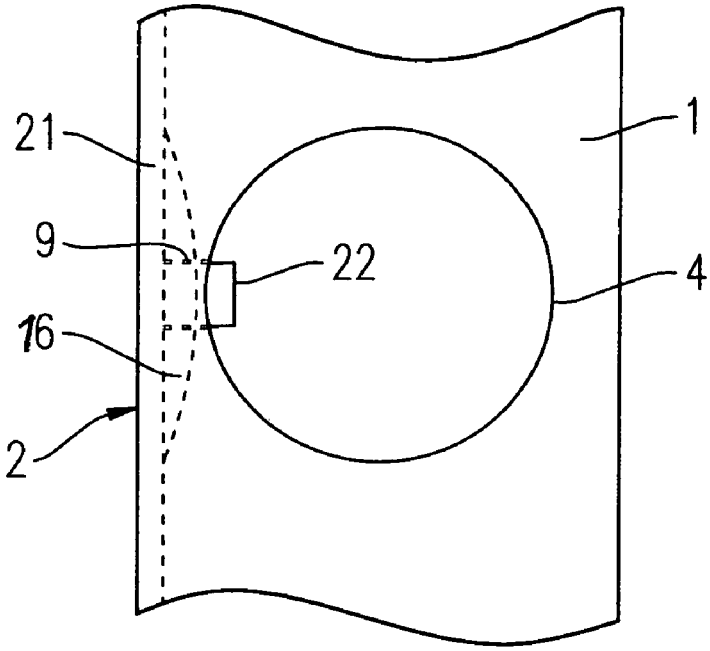
FIG. 7 is a plan view of a support part and a fastening device of the item of jewellery, no jewellery element however being yet fastened to the support part.

FIG. 7 shows a plan view of the item of jewellery from FIG. 6, no jewellery element 3 however yet being fastened to the support part 1.

As is apparent in FIGS. 6 and 7, the leaf spring 21 of the fastening device 2 according to the preferred embodiment described here, is flush mounted in an outer surface of the support part 1. Thus the leaf spring 21 of the item of jewellery according to the invention is visible from the outside and can thus form a design feature of the item of jewellery. Furthermore by such an arrangement of the leaf spring 21 incorrect operation of the fastening device 2 by becoming caught on items of clothing or the like can be largely avoided.

To allow easy and largely trouble-free external actuation of the leaf spring 21 without the use of tools, the support part 1 of the item of jewellery shown in FIG. 6 comprises in the region of the latching element 22 a chamfer 16 which allows an actuation of the leaf spring 21 by reaching behind. Thus the chamfer 16 is covered by one side edge of the leaf spring 21, whereby a negative visual effect created by the item of jewellery according to the invention is also prevented by the chamfer 16.

Figure 8:
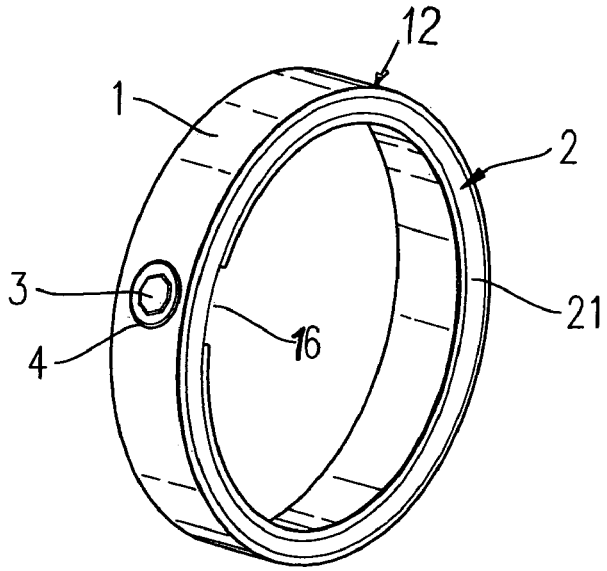
FIG. 8 is a perspective diagrammatic view of the item of jewellery of FIGS. 6 and 7.

In FIG. 8 the aforementioned item of jewellery according to the invention is shown in perspective. As is evident according to this preferred embodiment, the support part 1 is a jewellery ring and the leaf spring 21 of the fastening device 2 is of correspondingly annular construction. Alternatively, the support part could also, however, for example be a brooch or a link of a jewellery chain.

An alternative fourth embodiment of the item of jewellery according to the invention will hereinafter be described with reference to FIG. 9.

This fourth embodiment differs from the aforementioned third embodiment in particular in that the jewellery element 3 as shown in FIG. 3 comprises a cylindrical portion A and a head K.

Therefore it is possible via the jewellery element 3 to fasten releasably a decorative element 7, shown diagrammatically in plan view in FIG. 4 and which comprises a bore 8 for the cylindrical portion A of the jewellery element 3, to the support part 1 of the item of jewellery according to the invention. Moreover varying heights of the cylindrical portion A of different jewellery elements 3 can be selected, to be able to fasten either a plurality of decorative elements 7 simultaneously to the support part 1 or to allow adaptation to different thicknesses of the decorative element 7.

Figure 9:
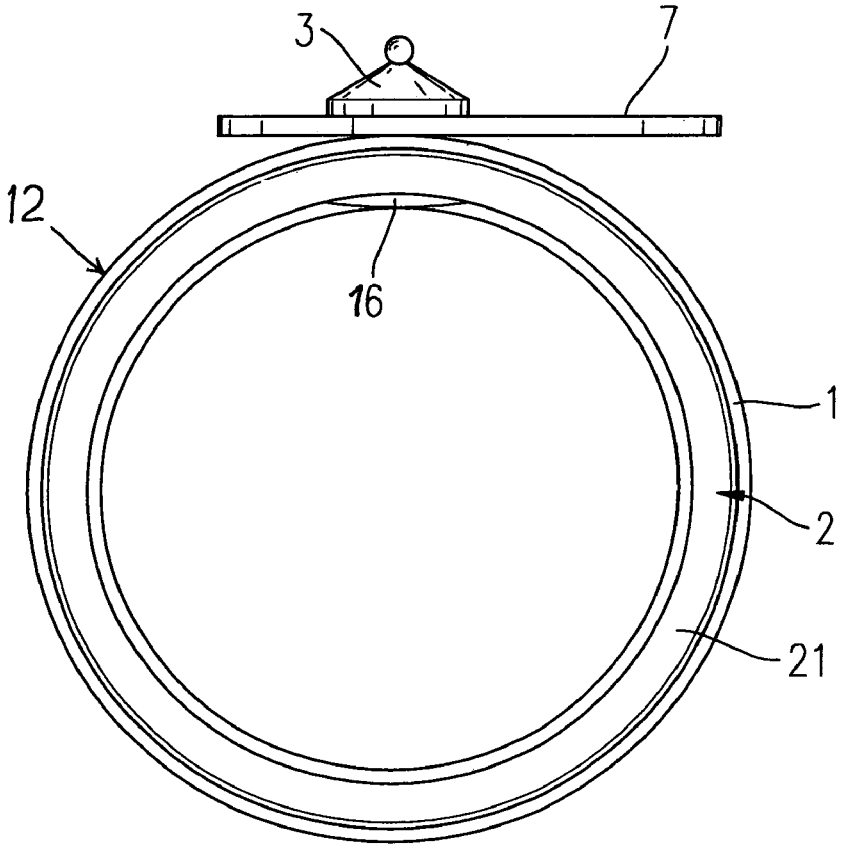
FIG. 9 is a side view of an item of jewellery according to the invention according to a fourth embodiment of the present invention.

FIG. 9 shows a side view of an item of jewellery according to the invention according to the aforementioned fourth embodiment, where the decorative element 7 is releasably fastened to the support part 1 via the jewellery element 3 by means of the fastening device 2.

In summary, the item of jewellery according to the invention allows easy fastening and removal of different jewellery elements on a support part without a separate tool being required therefor and at the same time reliably prevents inadvertent release of the connection between the support part and the jewellery element.

The invention claimed is:

1. Fastening system for fastening a jewellery element to an item of jewellery, comprising a setting constructed on the item of jewellery with a support part and a fastening device, and a jewellery element releasably fastenable to the support part of the setting by means of the fastening device, the support part comprising an aperture which is capable of at least partially receiving the jewellery element, said support part further comprising a groove, the groove being of an annular construction and surround the aperture for the jewellery element, the fastening device being constructed on the support part and comprising a leaf spring, said leaf spring being arranged in the groove of the support part and being of a correspondingly curved construction, and the jewellery element comprising a recess which is constructed to work in cooperation with the fastening device when the jewellery element is located in the aperture of the support part, wherein the leaf spring of the fastening device is externally actuatable and comprises a latching element constructed on the leaf spring, and the recess of the jewellery element is constructed to work in cooperation with the latching element of the fastening device when the jewellery element is located in the aperture of the support part.

2. Fastening system according to claim 1, wherein an actuation element is further provided on the fastening device to facilitate an external actuation of the leaf spring.

3. Fastening system according to claim 2, wherein the actuation element is constructed in the form of a lever which is arranged perpendicular to an extension direction of the latching element on the fastening device.

4. Fastening system according to claim 2, wherein a notch is provided in the support part to guide a movement of the actuation element.

5. Fastening system according to claim 1, wherein the leaf spring of the fastening device together with the latching element is tangentially displaceable in the groove of the support part after a radial actuation of the leaf spring.

6. Fastening system according to claim 1, wherein the aperture of the support part is designed as a cylindrical bore.

7. Fastening system according to claim 1, wherein the jewellery element is constructed as a setting for a precious stone or a pearl.

8. Fastening system according to claim 1, wherein the jewellery element comprises a chamfer below the recess which is constructed to facilitate manual engagement enabling a displacement of the latching element constructed on the leaf spring when the jewellery element is inserted into the aperture of the support part.

9. Fastening system for fastening a jewellery element to an item of jewellery, comprising a setting constructed on the item of jewellery with a support part and a fastening device, and a jewellery element releasably fastenable to the support part of the setting by means of the fastening device, the support part comprising an aperture which is capable of at least partially receiving the jewellery element, the fastening device being constructed on the support part and comprising a leaf spring, and the jewellery element comprising a recess which is constructed to work in cooperation with the fastening device when the jewellery element is located in the aperture of the support part, wherein the leaf spring of the fastening device is externally actuatable and comprises a latching element constructed on the leaf spring, in the support part perpendicular to the aperture for the jewellery element there is constructed a bore in which the latching element of the fastening device projecting into the aperture is guided, and the recess of the jewellery element is constructed to work in cooperation with the latching element of the fastening device when the jewellery element is located in the aperture of the support part.

10. Fastening system for fastening a jewellery element to an item of jewellery, comprising a setting constructed on the item of jewellery with a support part and a fastening device, and a jewellery element releasably fastenable to the support part of the setting by means of the fastening device, the support part comprising an aperture which is capable of at least partially receiving the jewellery element, the fastening device being constructed on the support part and comprising a leaf spring, and the jewellery element comprising a recess in the form of an annular groove which is constructed to work in cooperation with the fastening device when the jewellery element is located in the aperture of the support part, wherein the leaf spring of the fastening device is externally actuatable and comprises a latching element constructed on the leaf spring, and the recess of the jewellery element is constructed to work in cooperation with the latching element of the fastening device when the jewellery element is located in the aperture of the support part.

* * * * *